United States Patent [19]

Bögner

[11] Patent Number: 4,987,396

[45] Date of Patent: Jan. 22, 1991

[54] ELECTROMAGNETIC SWITCH, IN PARTICULAR FOR STARTING DEVICES OF INTERNAL-COMBUSTION ENGINES

[75] Inventor: Karl-Heinz Bögner, Neuhausen/F, Fed. Rep. of Germany

[73] Assignee: Robert Bosch GmbH, Stuttgart, Fed. Rep. of Germany

[21] Appl. No.: 335,789

[22] PCT Filed: Sep. 4, 1987

[86] PCT No.: PCT/DE87/00406

§ 371 Date: Mar. 24, 1989

§ 102(e) Date: Mar. 24, 1989

[87] PCT Pub. No.: WO88/02543

PCT Pub. Date: Apr. 7, 1988

[30] Foreign Application Priority Data

Sep. 24, 1986 [DE] Fed. Rep. of Germany ..... 3632469

[51] Int. Cl.[5] ..... H01H 67/02

[52] U.S. Cl. ..... 335/126; 335/131

[58] Field of Search ..... 335/131, 126, 255, 262, 335/133

[56] References Cited

U.S. PATENT DOCUMENTS 3,569,649 3/1971 Collins .
4,203,084 3/1980 Yamaguchi et al. .
4,293,835 10/1987 Davis et al. ..... 335/126

FOREIGN PATENT DOCUMENTS 1003318 2/1957 Fed. Rep. of Germany .
2315567 10/1974 Fed. Rep. of Germany .
2804815 8/1979 Fed. Rep. of Germany .

*Primary Examiner*—H. Broome
*Assistant Examiner*—Lincoln Donovan
*Attorney, Agent, or Firm*—Michael J. Striker

[57] ABSTRACT

An electromagnetic switch comprising primary current contacts having rounded contact surfaces inclined to the longitudinal axis of the electromagnetic switch, and a rotatable contact bridge having a spherical contact surface with a radius of curvature which is less than the radius of a rounded contact surface of a primary current contact.

9 Claims, 2 Drawing Sheets

ELECTROMAGNETIC SWITCH, IN PARTICULAR FOR STARTING DEVICES OF INTERNAL-COMBUSTION ENGINES

BACKGROUND OF THE INVENTION

The invention relates to an electromagnetic switch for starting devices of internal combustion engines. It is already known in the case of such a switch to provide primary current contacts with inclined flat contact surfaces and the contact bridge with correspondingly bent-off ends as contact sections. On closing of the contacts, the contact bridge and primary current contacts should lie against each other over a relatively large area. In this arrangement, it is of disadvantage that in plan view, a rectangular contact bridge requires an anti-rotation means, as otherwise no parallel contact making is possible. Such anti-rotation means is known, for example, in the form of ribs or walls in the cap which carries the primary current contacts and surrounds the switching space. Such anti-rotation means have, however, the disadvantage that, under harsh operational conditions of motor vehicles, vibrations can cause damage by in the cap because of notches therein and/or damage of the contact bridge or its insulating bearing parts, to which additionally the recoil force of the cap wall can contribute. In addition, with the relatively large level contact surfaces, it is of disadvantage that, with a view to a cost-effective mass production, the contact surfaces cannot be made so flat and/or kept so parallel to each other that contact making always takes place in the centre of the contact surfaces. As a result, no uniform heat dissipation is possible, so that the welding tendency of the contact parts increases in an undesired way. The friction on contact making of the contact surfaces inclined with respect to the switching direction can admittedly have the effect that corrosion deposits on the contact surfaces are dislodged and pushed away to a certain extent. With the relatively large contact surfaces, nevertheless it happens again and again that the contact making takes place at poorly conducting or otherwise unfavourable points, because the self-cleaning effect cannot become sufficiently effective here and the, in itself, desired high contact force can, with contact surfaces arranged obliquely to the switching movement, press the impurities into the contact surfaces..

SUMMARY OF THE INVENTION

The object of the invention is to provide an electromagnetic switch, in particular for starting devices of internal-combustion engines, the primary current contacts and contact bridge of which switch are designed in such a way that the disadventages of the known solutions are avoided and, as a result, the service life of the contact parts with, at the same time, increased requirements on their performance and a greater security against welding of the contact parts are achieved.

It is in this case of advantage that, with higher contact force, reduced bouncing tendency and good self-cleaning effect, it is made possible, by the shape of the contact surfaces, in a cost-effective way, always to achieve contact making at virtually the same point of the contact surfaces, even in the case of dimensional deviations, whereby a reliable contact making and a good heat dissipation is ensured without contact welding. It is to be regarded as a further advantage that the round contact bridge no longer requires lateral guidance, which likewise contributes to the increasing of the service life of the switch.

It is particularly advantageous that the primary current contacts are designed as screws with polygonal head, so that no anti-rotation means are required, since they can be fixed in their position in the cap in a simple way. In addition, the service life of the primary current contacts is increased due to the multiplicity of formed-on contact surfaces, by multiple using of the primary current contacts. With an angle of inclination of the contact surfaces to the switching movement of 45°, the most favourable relationship between contact force, bouncing tendency and self-cleaning is made possible. In a cost-effective way, the primary current contacts may be used (sic) not only of expensive copper but also of steel with a contact section of copper. Furthermore, due to the spherical section-shaped contact surface of the contact bridge, production tolerances can be compensated in such a way that the contact bridge always bears against the contact surface of the primary current contacts at virtually the same point. Due to the likewise spherically shaped rear portion of the contact bridge, and the somewhat conical shape of the contact point between contact bridge and contact bridge carrier, the compensating of dimensional deviations can be further provided.

The present invention as to its construction so to its mode of operation, together with additional objects and advantages thereof, will be best understood from the following description of preferred embodiment with reference to the accompanying drawings.

DESCRIPTION OF THE PREFERRED EMBODIMENTS

Figure 1:
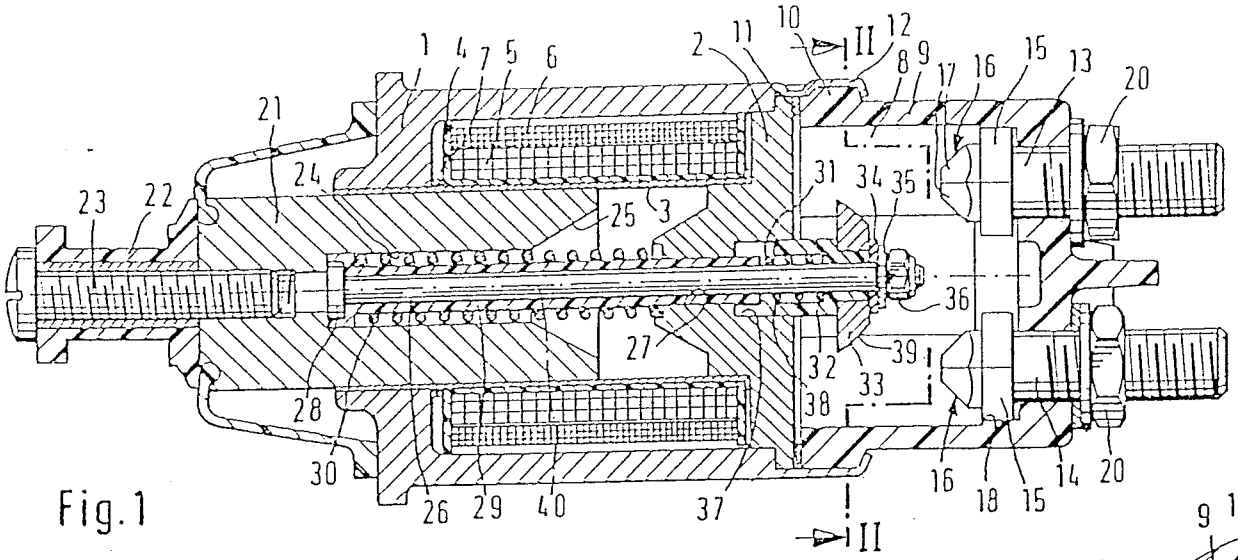
FIG. 1 shows a longitudinal cross-sectional view of an electromagnetic switch according to the invention.

An electromagnetic switch has a cup shaped housing 1, which at the same time serves as magnetic return yoke. A magnet core 2 bears against its end face. On a shoulder of the magnet core 2 is seated one end of a brass sleeve 3, the other end of which is fitted into a bore in the base of the housing 1. On the brass sleeve 3 is arranged a winding carrier 4, on which an exciter winding, which consists of a draw-in winding 5 and a holding winding 6, is accommodated. Between the base of the housing 1 and the winding carrier 4 is fitted a spring 7, which holds the winding carrier 4 in a tolerance-compensating and shakeproof manner in its position in the housing 1.

The outer end face of the magnet core 2 bounds a switching space 8, which is enclosed by a cap 9. The cap 9 has on its rim facing the magnet core 2 a flange 10. Between magnet core 2 and cap rim is inserted a spring element 11. A fastening rim 12 of the housing 1 engages over the magnet core 2, the spring element 11 and the flange 10 and is beaded behind the flange 10.

Into the cap 9 are fitted two primary current contacts 13 and 14, which are designed as screws, protrude with their head 15 into the switching space 8, have terminal bolts with thread which lead out of the cap 9, and are connected in a way, known per se, and not represented in any more detail to a positive pole of a battery and to the field winding of a starting motor, respectively. The primary current contacts 13 and 14 have a hexagonal head 15 with a contact section 16 inclined by generally 25°-60°, but preferably by 45°. The contact section 16 likewise hexagonal and has six trapezoidal contact surfaces 17 in the projection onto a plane perpendicular to the switching movement. The contact surfaces 17 are, however, rounded off in such a way that they are shaped as surface sections of cylinders or truncated cones. The head of the primary current contacts 13 and 14 is arranged fixedly against rotation in recesses 18 or between ribs 19 of the inner wall of the cap 9. By a respective nut 20, which is screwed externally onto the terminal bolt, the primary current contacts 13 and 14 are releasably fastened in the cap 9. The primary current contacts 13 and 14 are in this case fitted into the cap 9 such that two contact surfaces 17 lie opposite each other and form an angle of 90°.

In the brass sleeve 3, a magnet armature 21 is guided in a shakeproof manner. At its end protruding from the brass sleeve 3, and thus from the housing 1, a driver 22 of a plastic material is fastened by a screw 23 for an engaging lever, not represented in detail, of a meshing gear. The magnet armature 21 has a longitudinal bore 24, in the one end section of which, of smaller diameter, the screw 23 is screwed and the other end section 25 of which is widened in the shape of a funnel.

A switching bolt 26 made of diamagnetic material protrudes through a bore 27 in the magnet core 2 and extends with an end designed as collar 28 into the bore 24 of the magnet armature 21. On the collar 28 and the shank of the switching bolt 26, as far as into the bore 27 of the magnet core 2, a guide sleeve 29 of damping and insulating material is arranged, for example of a glass fibre-reinforced thermoplastic. The guide sleeve 29 serves as guide for the switching bolt 26 in the longitudinal bore 24 and supports a return spring 30, which brings both the magnet armature 21 and the contact bridge 33 into an initial position. It supports itself with one end on the collar 29 and bears with the other end against the magnet core 2.

The switching bolt 26 protrudes with an end section into the switching space 8. On the end section, a contact compression spring 31, a contact bridge carrier 32 of insulating material, which bears a contact bridge 33 rotatably arranged on the contact bridge carrier 32, an insulating disc 34 and a stop disc 35 are arranged and releasably fastened by a nut 36 screwed onto the end section. In the rest position of the switch, the contact bridge carrier 32 is seated in a widened end section 37 of the bore 27 of the magnet core 2. The contact compression spring 31 supports itself with one end in the contact bridge carrier 32 and bears with the other end against the end face 38 of the guide sleeve 29.

Due to the preload of the return spring 30, the spring arrangement 30, 31 holds the assembly of switching bolt 26, 28 together with guide sleeve 29, 38, contact bridge 32 with contact bridge 33, and the magnet armature 21 in the rest position represented in FIG. 1.

The contact bridge 33 is rounded and has a contact surface 39, which is part of a spherical cup, the centre point of which lies on the longitudinal axis 40 of the switch. The radius of the contact surface 39 is smaller than the radius of the rounded-off contact surfaces 17 of the primary current contacts 13 and 14.

With excited winding 5, 6, the magnet armature 21 is drawn to the magnet core 2, against the force of the return spring 30, which is further tensioned, for meshing of the starting pinion, not represented, of the meshing gear mentioned, via the engaging lever, likewise not represented, and articulated on the driver 22 of the magnet armature 21. In this process, the switching bolt 26 together with guide sleeve 29 and the contact bridge carrier 32, which is arranged on the said switching bolt, are moved with the contact bridge 33 along with the magnet armature 21. In this movement, the switching bolt 26 is pushed further into the switching space 8, so that the contact bridge 33 is pressed with its contact surface 39 against the assigned contact surfaces 17 of the primary current contacts 13 and 14 and, with support of the force of the contact compression spring 31, is held against the primary current contacts 13 and 14. As a result, the starting motor, not represented, connected to the terminal bolt of the primary current contact 13, is connected in a way, known per se, to the current source, likewise not represented, connected to the terminal bolt of the primary current contact 14. The starting motor receives current for starting of the internal-combustion engine.

Once the internal-combustion engine has started, the current supply to the exciter winding 5, 6 of the electromagnetic switch is switched off. The return spring 30, provided with substantially greater spring force than the contact compression spring 31, holds the switching bolt 26 with its collar 28 pressed against the magnet armature 21 pushed back into its rest position. In this movement, the switching bolt 26 takes the contact bridge 33 with it and separates it from the primary current contacts 13 and 14, so that the movable switching parts 21 to 39 again assume their rest or initial position represented in FIG. 1.

The contact surface 39 of the round contact bridge 33, provided with the shape of a spherical cup section, and the rounded-off contact surfaces 17 of the primary current contacts 13 and 14 are designed such that, in the new state, the contact making takes place in the first third of the contact surface 39 of the contact bridge 33 facing the primary current contacts 13 and 14. In this case, a good heat dissipation 39 from the contact points is achieved. No anti-rotation means is required for the round contact bridge 33. Vibrations may affect the contact bridge 33 in a desired way by enabling the contact bridge 33 to turn on the contact bridge carrier 32 about the longitudinal axis 40 of the switch. As a result, other substantially punctiform points of the contact surface 39 always come into contact with the contact surfaces 17 of the primary current contacts 13 and 14 and never on the edges. The primary current contacts 13 and 14 can be used repeatedly. If the contact surface 17 no longer insure a good contact, the primary current contacts 13 and 14 are turned about their longitudinal axis, in the recess 18 and/or between the ribs 19 of the cap 9, to the extent that the contact bridge 33, 39 can bear against another contact surface 17. Because the contact surfaces 17 and 39, are inclined to the switching direction, the bouncing effect is reduced. In addition, as a result, the contact force and the self-cleaning effect of the contact surfaces are increased. The service life and performance of the electromagnetic switch are consequently increased.

Figure 2:
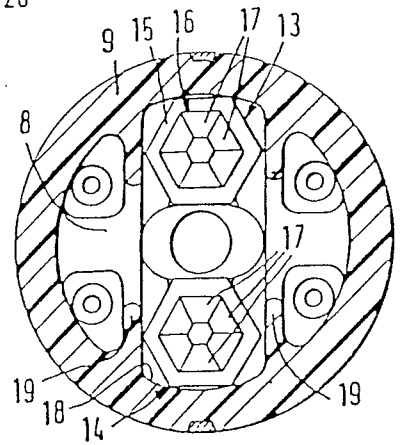
FIG. 2 shows a sectional view of the switch along the line II—II in FIG. 1.
Figure 3:
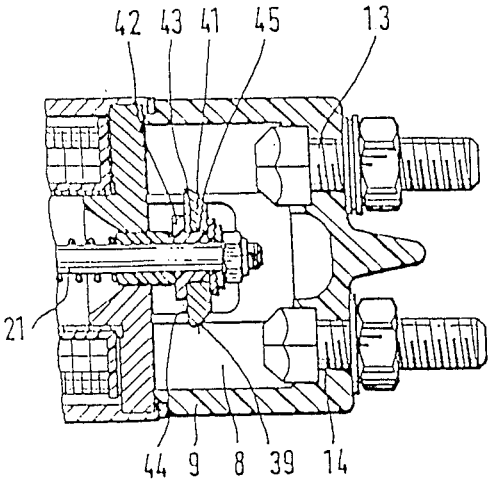
FIG. 3 shows the a partial longitudinal section view of a switch with a modified contact bridge.

The electromagnetic switch represented in FIG. 3 has a modified contact bridge 41. Where the parts are the same as those of the exemplary embodiment according to FIGS. 1 and 2, they have the same reference numerals.

The contact bridge carrier 42 has a bearing attachment 43, which tapers somewhat towards its free end and on which the contact bridge 41 is rotatably mounted. The rear portion 44 of the contact bridge 41 is likewise designed as section of a spherical cup with a substantially greater radius of curvature than that of the contact surface 39.

Inclined somewhat towards the longitudinal axis 40 of the switch, the contact bridge 41 can thus compensate for dimensional deviations, which for due to production tolerances. As a result, the contact making of the contact surfaces 39 and 17 of the contact bridge 41 and of the primary current contacts 13 and 14, respectively, always takes place at the desired point.

When a cylindrical bearing attachment is used instead of the tapering bearing attachment 43 of the contact bridge carrier 42, it is also possible, with for the bearing bore 45 of the contact bridge 41 to be designed somewhat conically.

The first embodiment of the primary current contacts 13 and 14 according to FIGS. 1 to 3 has contact surfaces 17 which are designed as fillets in the shape of cone surface sections or cylinder surface sections, which extend over the entire trapezoidal surfaces of the contact section.

Figure 4:
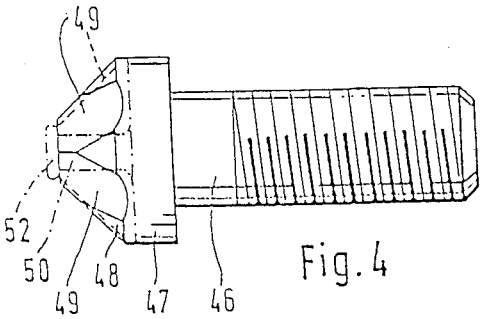
FIG. 4 shows a side view of a second embodiment of a primary current contact.
Figure 5:
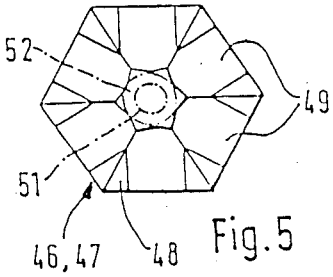
FIG. 5 shows a plan view of the contact section of the primary current contact according to FIG. 4.

A second embodiment of primary current contacts is represented in FIGS. 4 and 5. A primary current contact 46 again has a hexagonal head 47, which is provided with a contact section 48 inclined by 45° to the longitudinal axis and thus to the switching direction. The six trapezoidal segments of the contact section 48 are each provided with a cylinder surface-shaped fillet as contact surfaces 49, which extends over the central part of the trapezoidal segments.

For the primary current contact 46 of electrically well conducting material such as copper, another modification for the material used is indicated in dot-dashed lines in FIGS. 4 and 5. The primary current contact 46 is designed with terminal bolts and head 47, for example, of steel. A bearing attachment 50 is formed at the end face of the head 47. The contact section 48 is made of copper and provided with cylinder surface section-shaped contact surfaces 49 and with a longitudinal bore 51. The contact section 48 is pushed onto the bearing attachment 50. With the end 52 of the bearing attachment 50 protruding from the longitudinal bore 51, the contact section 48 is riveted onto the primary current contact 46. Particularly for large electromagnetic switches, the associated, correspondingly large, primary current contacts can thus be produced cost-effectively, which is necessary above all in the case of mass production.

Figure 6:
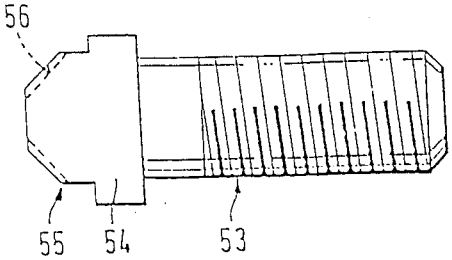
FIG. 6 shows a side view of a third embodiment of the primary current contact and FIG. 7 shows a plan view of the primary current contact according to FIG. 6.
Figure 7:
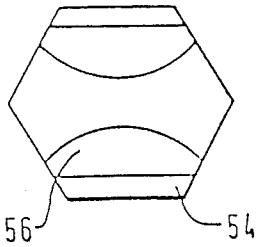

With primary current contacts for great heat absorption upon contact making, a contact section such as that represented in a third embodiment of a primary current contact 53 according to FIGS. 6 and 7 is suitable. The head 54 of the primary current contact 53 is again designed as a hexagon. The contact section 55 is inclined with respect to the switching direction only on two sides. These sides are rounded off as contact surfaces 56. The wear on the primary current contacts 57 is less with the particularly favourable heat dissipation of the contact bearing point. Therefore, two contact surfaces 57 per primary current contact 53 are also sufficient for the service life of the switching device. The higher copper requirement, and thus the higher price, therefore justify in particular the application of this embodiment in cases of special models of electromagnetic switches.

While the invention has been illustrated and described as embodied in an electromagnetic switch for starting devices of internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electromagnetic switch in particular for starting devices of internal combustion engines, said electromagnetic switch having a longitudinal axis and comprising a housing having a switching space and an end; an exciter coil; a winding carrier for supporting said exciter coil; a guide sleeve located in said housing for supporting said winding carrier with said exciter coil; a magnet core arranged on said end face of said housing; a magnet armature guided in said guide sleeve; a return spring for biasing said magnet armature away from said magnet core; a switching bolt displaceable with said magnet armature and extending through said magnet core and into said switching space; a contact bridge carrier carried by said switching bolt; a contact bridge supported by said contact bridge carrier; a cap for covering said switching space; and two primary current contacts extending through said cap and into said switching space and located opposite said contact bridge, each of said primary current contact having at least one prismatic contact section inclined at an angle of 25°–60° to the longitudinal axis of said electromagnetic switch, said contact section including a plurality of contact surface each having a longitudinal axis inclined to the longitudinal axis of said electromagnetic switch and lying in a plane extending radially through the longitudinal axis of said electromagnetic switch, said contact bridge being round and including a spherical contact surface having a center of curvature which lies on the longitudinal axis of said electromagnetic switch, and a first radius, each of said contact surfaces being rounded and having a second radius which is greater than the first radius of said spherical contact surface of said contact bridge.

2. An electromagnetic switch according to claim 1, wherein said contact section is inclined to the longitudinal axis of said electromagnetic switch at an angle of substantially 45°.

3. An electromagnetic switch according to claim 1, wherein said contact section has a polygon cross-section and said contact surface has a form of a rounding formed as a cone surface section, and, when projected onto a plane extending perpendicular to the longitudinal axis of said electromagnetic switch, has a trapezoidal shape.

4. An electromagnetic switch according to claim 1, wherein said contact section has a polygon cross-section and said contact surface has a form of a rounding formed as a cylindrical surface section, and, when projected onto a plane extending perpendicular to the longitudinal axis of said electromagnetic switch, has a trapezoidal shape.

5. An electromagnetic switch according to claim 1, wherein each primary current contact has a head having a polygon cross-section and two inclined contact sections each of which is formed as a rounded contact surface.

6. An electromagnetic switch according to claim 1, wherein each of said primary current contacts is formed as a screw made of copper, and has a head on which said contact section with said contact surface is formed.

7. An electromagnetic switch according to claim 1, wherein each of said primary current contacts is formed as a screw made of steel, and has a head, said contact section having contact surface being made of copper and being attached to said head.

8. An electromagnetic switch according to claim 1, wherein said contact bridge has a portion facing away from said primary current contacts, said facing-away portion having a spherical surface having a center of curvature which lies on the longitudinal axis of said electromagnetic switch, and a third radius which is greater than said second radius of said contact surface of said contact section.

9. An electromagnetic switch according to claim 1, further comprising a bush made of insulating material for rotatably supporting said contact bridge, said contact bridge having a bore and said bush having an outer surface received in said bore, at least one of said bore and outer surface being conical.

* * * * *